US005262039A

United States Patent [19]

den Hartog et al.

[11] Patent Number: 5,262,039

[45] Date of Patent: Nov. 16, 1993

[54] SILICON-CONTAINING IRON SHEET FOR ELECTRICAL APPLICATIONS AND METHODS FOR ITS MANUFACTURE

[75] Inventors: Huibert W. den Hartog, Noordwijkerhout; Gijsbertus C. van Haastrecht, Heemskerk, both of Netherlands

[73] Assignee: Hoogovens Groep BV, IJmuiden, Netherlands

[21] Appl. No.: 961,346

[22] Filed: Oct. 15, 1992

[30] Foreign Application Priority Data

Oct. 16, 1991 [NL] Netherlands ..... 9101722

[51] Int. Cl.[5] ..... C25D 1/04

[52] U.S. Cl. ..... 205/78

[58] Field of Search ..... 205/78

[56] References Cited

U.S. PATENT DOCUMENTS 3,423,253 1/1969 Ames ..... 148/110

4,076,597 2/1978 Subramanyan et al. ..... 204/13

FOREIGN PATENT DOCUMENTS 2004272 10/1970 Fed. Rep. of Germany .

870870 6/1961 United Kingdom .

1086215 10/1967 United Kingdom .

OTHER PUBLICATIONS

Polytechnisch Tijdschrift: Werktuigbouw, vol. 26, No. 23, 1971 pp. 994–1006.

*Primary Examiner*—T. M. Tufariello

*Attorney, Agent, or Firm*—Stevens, Davis, Miller & Mosher

[57] ABSTRACT

In the manufacture of a silicon-containing iron sheet for electrical applications consisting of 0.1–8% by weight Si, optionally up to 1% by weight Al, remainder iron and unavoidable impurities, iron sheet is made by electrodeposition, and silicon or a silicon-containing material is incorporated in the electro-deposited iron sheet. The silicon-containing material may be included in the electrolyte, becoming embedded during the electrodeposition in the iron sheet. The method can be performed without a step of thickness reduction of the iron sheet made by electro-deposition. The sheet is annealed to homogenize the silicon content.

15 Claims, 1 Drawing Sheet

SILICON-CONTAINING IRON SHEET FOR ELECTRICAL APPLICATIONS AND METHODS FOR ITS MANUFACTURE

BACKGROUND OF THE INVENTION

1. Field of the Invention

The invention relates to a silicon-containing iron sheet for electrical applications. The invention also relates to methods for the manufacture of a silicon-containing iron sheet for electrical applications.

2. Description of the Prior Art

It is well known to alloy steel sheet with silicon for electrical applications, order to reduce power losses occurring with use of alternating current. These losses consist of two components, namely losses resulting from eddy currents and hysteresis losses. Eddy current losses reduce greatly as the content of silicon in the steel increases; hysteresis losses are dependent on impurities in the steel and irregularities in the crystal structure of the steel and increase slightly by alloying with silicon.

A frequent application of such steel sheet, to reduce power losses, is to be found in the form of flat or cylindrical sheet packs or stacks. Where the steel sheet thickness is small eddy current losses decrease greatly.

However, the present optimum in the silicon content and the thickness of such sheet is not solely determined by the requirements for reduction of power losses, but other factors also play their part. In the known steel sheet for electrical applications the final thickness is obtained by rolling, in other words it is a rolled product. With a silicon content exceeding 3½% to 4% the steel becomes very difficult to cold-roll and can thus only be hot-rolled. At the same time the steel becomes brittle and consequently difficult to work, for example for subsequent die-stamping of laminates. Rolling costs are higher for small thicknesses so that the minimum practical thickness is also determined by economic factors.

In certain applications there are limits to the thickness of the steel sheet to be used, these limits relating to the stackability of the packs and their desired structural stiffness.

In practice, as a result of the above-mentioned circumstances, there is no industrial-scale manufacture of steel sheet for electrical applications with a silicon content exceeding 3½% to 4% and with a thickness of under 0.15 mm.

Examples of processes described in the prior art of making silicon-containing steel sheet, known as silicon steel, are given in U.S. Pat. No. 3,423,253 and DE-A-2004272. U.S. Pat. No. 3,423,253 is concerned with increasing the silicon content of a wrought silicon steel strip, i.e. a product made by rolling, and describes deposition of silicon onto the silicon steel from vapour by thermal decomposition of a silicon compound, followed by heat-treating the steel to homogenize it. DE-A-2004272 is also concerned with increasing the silicon content of a silicon steel, made by a melting process, by deposition of silicon from vapour and heating to achieve a desired microstructure. JP-A-62-227035 has a similar disclosure. Such silicon steels contain other elements characteristic of steel-making processes, such as particularly C, Mn, P, S, etc.

GB-A-870870 and GB-A-1086215 on the other hand describe silicon-containing iron sheet, which is substantially pure Fe containing Si. To make this material, highly pure electrolytically deposited iron is used as a starting material for a melt for forming the Si-Fe alloy.

The ingot cast from this melt is then rolled, to a thickness of 250 μm or more.

It is mentioned for completeness that it is known to make thin sheet of pure iron by electrolytic deposition, as illustrated for example by EP-A-501548 and U.S. Pat. No. 4,076,597.

SUMMARY OF THE INVENTION

An object of the invention is at least partly to overcome the disadvantages of the prior art and to provide a sheet which can have a high silicon content and/or a small thickness and which may be manufactured economically on an industrial scale and which displays low power loss in electrical applications.

The invention is based on the discovery that silicon can be incorporated in the desired amount in electrodeposited iron sheet.

According to this invention in one aspect there is provided a silicon-containing iron sheet for electrical applications consisting of 0.1–8% by weight Si, optionally up to 1% by weight Al, remainder Fe and unavoidable impurities, the sheet being unrolled and having a metallurgical structure characteristic of an electrodeposited sheet of iron.

According to the invention there is also provided a silicon-containing iron sheet for electrical applications consisting of 0.1–8% by weight Si, optionally up to 1% by weight Al, remainder Fe and unavoidable impurities, the sheet being unrolled and having a crystal structure of elongate grains extending in the sheet thickness direction adjacent one face and round grains adjacent the other face. Such a structure is typical of an electrodeposited sheet.

As a result of the electro-deposition, a sheet according to the invention may have at one face a smooth surface and at the other face a surface substantially rougher than said smooth surface. This rougher surface, which is on the electrolyte side in the deposition process, may be smoothed after the electro-deposition. In its unsmoothed state, this rough surface may have a roughness of about 20% of the thickness.

In this specification and claims, the term "unrolled" means a sheet which has not been rolled to reduce its thickness, but which may have been rolled for example for stretching or flattening before and/or after any heat treatment or for smoothing a rough surface present on one face as a result of the electro-deposition.

Typically, the sheet according to the invention does not contain the elements such as C, Mn, Al, P and S characteristic of steel production. However Al may optionally be present up to 1% by weight and other elements may be present as impurities resulting from steel scrap used for the electrolyte. On the other hand, electro-deposition elements may be present as impurities also, typically Cu, which can be found up to 1% by weight. The advantage of this composition is that the sheet of the invention is very pure so that hysteresis losses are low.

The thickness of the sheet in accordance with the invention is preferably less than 0.5 mm and more preferably under 150 μm. Thus the sheet may be a thin foil. By the invention it is possible to achieve small thicknesses in an economic and simple manner, and the desired silicon content is easily obtained.

A method according to the invention for the manufacture of a silicon-containing iron sheet for electrical applications consisting of 0.1–8% by weight Si, optionally up to 1% by weight Al, remainder iron and unavoidable impurities, comprises the steps of manufacturing iron sheet by means of electro-deposition and incorporating silicon or a silicon-containing material in the iron sheet, said method being performed without a step of thickness reduction of the iron sheet made by electro-deposition.

In other words the desired thickness of the sheet is obtained not by means of a rolling process but rather by an electro-deposition process. This method overcomes the existing technical and economical limitation to larger thicknesses in the case of steel sheet for electrical applications obtained by rolling. The surface of the sheet obtained by electro-deposition is very suitable for stacking into a desired assembly for an electrical device.

This method preferably also includes the step of homogenizing the silicon content in the iron sheet by diffusion of silicon in the iron sheet by heat treatment. However heat treatment may not be necessary, in the method, if there is included the step of providing fine particles of silicon-containing material in an electrolyte used for manufacture of the iron sheet by electro-deposition, so that the fine particles become embedded in the iron sheet during the electro-deposition. This method can be performed with or without a heat treatment for diffusion. The silicon-containing material may be FeSi.

In another aspect the invention provides a method for the manufacture of a silicon-containing iron sheet for electrical applications consisting of 0.1–8% by weight Si, optionally up to 1% by weight Al, remainder iron and unavoidable impurities, which method comprises the steps of manufacturing iron sheet by means of electro-deposition, supplying silicon or a silicon-containing material to said iron sheet, and at least partly homogenizing the silicon content in the iron sheet.

In the preferred method, the desired silicon content in the sheet is obtained by diffusion of silicon in the iron sheet at high temperature. By reason of the diffusion rate of silicon in iron, it may be taken that the temperature when annealing for the diffusion should in general be higher than 1000° C. for obtaining acceptable processing times. However on diffusion, initial diffusion also takes place along the grain boundaries in the iron sheet. At a lower temperature, this diffusion is faster than the diffusion of silicon in iron.

In one preferred embodiment of the invention the silicon to be diffused is supplied by particles of silicon-containing material which are present in dispersed state in an electrolyte which is used in the production of iron sheet by electro-deposition, and which become embedded in the iron sheet simultaneously with the electro-deposition of the iron. The advantage of this is that the silicon for the diffusion is already present to a certain level homogeneously distributed in the sheet, so that compared with the embodiments of the invention to be discussed below, the diffusion may take place in a shorter time and consequently the annealing time may be shorter. The silicon-containing material may be FeSi.

In a second preferred embodiment the silicon to be diffused is supplied from a silicon-containing vapour, by contacting the iron sheet with vapour and depositing silicon or a said silicon-containing material on the surface of the iron sheet by a chemical vapour deposition process.

A third preferred embodiment of the method includes supplying the silicon to be diffused by applying silicon or silicon-containing material onto a surface of the iron sheet by means of a physical vapour deposition process.

In a fourth embodiment of the invention the silicon to be diffused in the iron sheet is provided by silicon or silicon-containing material which is applied to the iron sheet by sputtering or implantation, e.g. into a surface layer of the sheet.

The diffusion should preferably take place in the coil of the sheet by box annealing. This produces a homogeneous product of constant quality. The diffusion may also be effected on lamellae which have been cut from the sheet.

BRIEF INTRODUCTION OF THE DRAWINGS

Embodiments and an Example of the invention will now be described by way of non-limitative example with reference to the accompanying drawings, in which.

DESCRIPTION OF THE PREFERRED EMBODIMENTS

Figure 1:
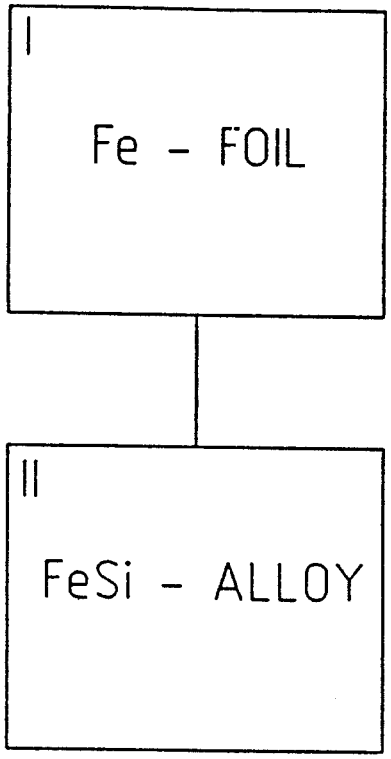
FIG. 1 is a block diagram of the method for manufacturing silicon-containing iron sheet for electrical applications in accordance with an embodiment of the invention.

As FIG. 1 shows, the method for the manufacture of silicon-containing iron sheet for electrical applications in accordance with an embodiment of the invention comprises two stages, namely:

stage I: the manufacture of iron sheet by means of electrodeposition;

stage II: the manufacture of the iron-silicon alloy by diffusion of silicon in the iron sheet.

Figure 2:
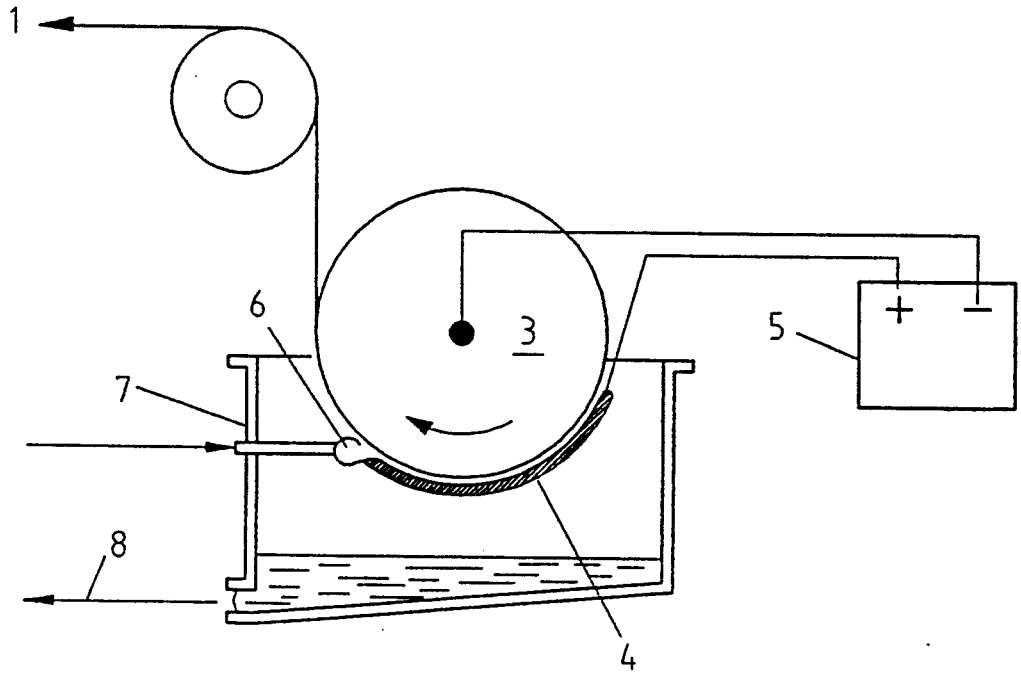
FIG. 2 shows an apparatus for the manufacture of iron sheet.

An apparatus for carrying out stage I is shown in FIG. 2. In that Figure a drum 3 with a metal surface is shown connected to a source of power (5) as a cathode. Drum 3 is surrounded over a part of its circumference by an anode 4 likewise connected to the source of power 5. Between the cathode 3 and anode 4 there is a gap which, in the indicated direction of rotation of the drum 3, is continuously filled at its exit end with electrolyte from a nozzle 6. In the gap electrodeposition of iron from the electrolyte takes place onto the drum 3. The iron deposited onto the drum 3 in the form of a thin sheet or foil 1 is taken off the drum 3 and transported away. Consumed electrolyte is collected in a tank 7 and taken away at 8. In this manner an iron foil may be obtained with a selected thickness ranging from approximately 10 μm upwardly and with a very good strip shape.

The above-named stages I and II are carried out successively. Stage II is broken down into two substages, namely:

stage IIa the application of a silicon supply into the iron sheet or onto the surface of the iron sheet, and stage IIb the manufacture of the iron-silicon alloy by diffusion of the silicon in the iron sheet.

Stage IIb is carried out at a temperature and for a time such that a desired homogeneity of distribution of the silicon is obtained in the iron sheet. In this annealing, temperatures of at least 1000° C. are employed.

Method of performing stage IIa are described above. Stage IIa may be combined with stage I, in the case where a silicon-containing compound in particulate form is present in the electrolyte and becomes incorporated in the iron sheet during electro-deposition.

EXAMPLE

Iron sheet is manufactured using the apparatus shown in FIG. 2. The circumferential velocity of the drum is 10 m/min.

Use is made of an electrolyte containing iron, FeSi particles and chloride ions with a pH about 1.8 and with the following composition:

| | |
|---|---|
| $Fe^{2+}$ | 250 g/l |
| $Fe^{3+}$ | 3 g/l |
| $Cl^-$ | 300-350 g/l |
| FeSi particles | 40 g/l |

The particle size of the FeSi particles is 0.5-2 μm.

The temperature of the electrolyte is 105° C. The current density is 200 A/dm$^2$. The anode/cathode spacing is 2 mm. The electrolyte velocity in the anode/cathode gap is 4 m/s. The voltage drop across the cell is 4 V.

There is produced an iron sheet with a thickness of 20 μm and a width of 1000 mm.

Similar processes have been successfully performed over a current density range from 100 to 200 A/dm$^2$ and an applied voltage range from 1 to 6 V. The anode/cathode spacing is preferably 1 to 3 mm. In these processes, the maximum production capacity is approximately 94 kg/hour, being limited by the capacity of the current rectifier used which is approximately 90 kA. The thicknesses of the iron sheet obtained lie typically in the range 10 to 60 μm.

The iron sheet is heat treated for 5 minutes at a temperature of 1150° C. in an inert gas atmosphere.

There is produced an iron sheet which consists of 6% Si, remainder Fe except for traces of impurities only. This iron sheet has on one side a structure of elongate grains extending in the sheet thickness direction and a surface with a surface roughness of about 20% of the thickness of the iron sheet and on the other side a structure of round grains and a smooth surface. The iron sheet has a (110)[001]orientation in the length direction of the sheet.

Although in the example the production of iron sheet and the heat treatment are separate operations it is feasible to execute these operations in-line in a continuous process.

What is claimed is:

1. A method for the manufacture of a silicon-containing iron sheet for electrical applications consisting of 0.1-8% by weight Si, optionally up to 1% by weight Al, remainder iron and unavoidable impurities comprising the steps of manufacturing iron sheet by means of electrodeposition, supplying silicon or a silicon-containing material to said iron sheet, and at least partly homogenizing the silicon content in the iron sheet.

2. A method according to claim 1 wherein said step of at least partly homogenizing the silicon content in the iron sheet is effected by diffusion of silicon in the iron sheet in a heat treatment.

3. A method according to claim 2 including supplying the silicon to be diffused by providing particles of silicon-containing material in dispersed state in an electrolyte used in the manufacture of iron sheet by electrodeposition so that the particles are embedded in the iron sheet simultaneously with the electrodeposition of the iron in the production of the iron sheet.

4. A method according to claim 3 wherein said silicon-containing material is FeSi.

5. A method according to claim 2 wherein the silicon to be diffused is supplied from a silicon-containing vapour, by contacting the iron sheet with said vapour and depositing silicon or a said silicon-containing material on the surface of the iron sheet by a chemical vapour deposition process.

6. A method according to claim 2 including supplying the silicon to be diffused by applying silicon or silicon-containing material onto a surface of the iron sheet by means of a physical vapour deposition process.

7. A method according to claim 2 including supplying the silicon to be diffused in the iron sheet by applying silicon or said silicon-containing material to the iron sheet by sputtering or implantation.

8. A method according to claim 2 wherein said heat treatment comprises box annealing a coil of the sheet.

9. A method according to claim 2 wherein said heat treatment is effected on lamellae which have been cut from the sheet.

10. A method according to claim 5 wherein the thickness of said iron sheet manufactured by electrodeposition is not more than 0.5 mm.

11. A method according to claim 6 wherein the thickness of said iron sheet manufactured by electrodeposition is not more than 150 μm.

12. A method according to claim 1 wherein the thickness of said iron sheet manufactured by electrodeposition is not more than 0.5 mm.

13. A method according to claim 1 wherein the thickness of said iron sheet manufactured by electrodeposition is not more than 150 μm.

14. A method for the manufacture of a silicon-containing iron sheet for electrical applications consisting of 0.1-8% by weight Si, optionally up to 1% by weight Al, remainder iron and unavoidable impurities comprising the steps of manufacturing iron sheet by means of electrodeposition and incorporating silicon or a silicon-containing material in the iron sheet and homogenizing the silicon content in the iron by diffusion of silicon in the iron sheet by heat treatment, said method being performed without a step of thickness reduction of the iron sheet made by electrodeposition.

15. A method for the manufacture of a silicon-containing iron sheet for electrical applications consisting of 0.1-8% by weight Si, optionally up to 1% by weight Al, remainder iron and unavoidable impurities comprising the steps of manufacturing iron sheet by means of electrodeposition and incorporating silicon or a silicon-containing material in the iron sheet by providing fine particles of FeSi in an electrolyte used for the manufacture of the iron sheet by electrodeposition, so that said fine particles become embedded in the iron sheet during the electrodeposition, said method being performed without a step of thickness reduction of the iron sheet made by electrodeposition and without a heat treatment for diffusion.

* * * * *